US009340976B2

(12) United States Patent
Labonté

(10) Patent No.: US 9,340,976 B2
(45) Date of Patent: May 17, 2016

(54) SUSPENDED CEILING

(75) Inventor: Patrick Labonté, Laval (CA)

(73) Assignees: LES PLAFONDS EMBASSY INC., Laval, Quebec (CA); EMBASSY CEILING INC., Laval, Quebec (CA)

( * ) Notice: Subject to any disclaimer, the term of this patent is extended or adjusted under 35 U.S.C. 154(b) by 0 days.

(21) Appl. No.: 12/113,159

(22) Filed: Apr. 30, 2008

(65) Prior Publication Data

US 2008/0276560 A1 Nov. 13, 2008

(30) Foreign Application Priority Data

Apr. 30, 2007 (CA) ..... 2588300

(51) Int. Cl.

| | |
|---|---|
| ***E04B 9/06*** | (2006.01) |
| ***E04B 9/04*** | (2006.01) |
| ***E04B 9/28*** | (2006.01) |
| ***E04B 9/30*** | (2006.01) |

(52) U.S. Cl.

CPC ..... *E04B 9/064* (2013.01); *E04B 9/0435* (2013.01); *E04B 9/28* (2013.01); *E04B 9/30* (2013.01)

(58) Field of Classification Search

CPC ..... E04B 9/10; E04B 9/18; E04B 9/183; E04B 9/20; E04B 9/205; E04B 9/22; E04B 9/225; E04B 9/247; E04B 9/26; E04B 9/30; E04B 9/064; E04B 9/0435; E04B 9/28; E04F 13/07; E04F 13/0821; E04F 13/0825; E04F 13/0826; E04F 13/0828

USPC ..... 52/204.56, 506.01, 506.04, 506.06, 52/506.07, 506.08, 506.09, 511

See application file for complete search history.

(56) References Cited

U.S. PATENT DOCUMENTS

| | | | | |
|---|---|---|---|---|
| 2,130,531 | A * | 9/1938 | Arand | 52/506.09 |
| 2,971,617 | A | 2/1961 | Smith. et al. | |
| 3,241,280 | A * | 3/1966 | Kreuzer | 52/506.06 |
| 3,342,006 | A | 9/1967 | Joseph et al. | |
| 3,385,021 | A | 5/1968 | Nys | |
| 3,557,505 | A | 1/1971 | Pechenik | |
| 3,583,119 | A | 6/1971 | Kann | |
| 3,594,972 | A | 7/1971 | Jones et al. | |
| 3,685,235 | A | 8/1972 | Lang | |
| 3,742,674 | A | 7/1973 | Lang | |
| 3,785,110 | A | 1/1974 | Galloway et al. | |
| 3,936,990 | A | 2/1976 | Garrison, Jr. et al. | |
| 4,055,930 | A | 11/1977 | Weinar et al. | |
| 4,189,888 | A | 2/1980 | Blitzer, Jr. | |

(Continued)

FOREIGN PATENT DOCUMENTS

| | | |
|---|---|---|
| CA | 2525023 | 5/2006 |

*Primary Examiner* — Basil Katcheves
*Assistant Examiner* — Theodore Adamos
(74) *Attorney, Agent, or Firm* — Equinox IP; Franz Bonsang

(57) ABSTRACT

A modular ceiling comprising first and second main runners defining an upper surface and a lower surface, the upper surface defining a longitudinal retaining cavity along the first main runner and two grooves disposed parallel to and, respectively, on each side from the longitudinal retaining cavity; a cross member installable at an angle from the main runners and adapted to connect the first main runner with the second main runner, the cross member being secured to the main runners by a cross member fastener having a cross runner anchor adapted to engage the groove defined in main runners; and a panel adapted to be disposed between main runners and being supported, at least in part, by main runners.

8 Claims, 7 Drawing Sheets

(56) References Cited

U.S. PATENT DOCUMENTS

| | | | | | |
|---|---|---|---|---|---|
| 4,281,498 | A | | 8/1981 | Kern | |
| 4,361,996 | A | | 12/1982 | Smith | |
| 4,367,616 | A | | 1/1983 | Pearson | |
| 4,370,373 | A | | 1/1983 | Janicz | |
| 4,452,021 | A | * | 6/1984 | Anderson | 52/506.07 |
| 4,454,700 | A | * | 6/1984 | Kern | 52/665 |
| 4,464,876 | A | | 8/1984 | Kern | |
| 4,479,341 | A | | 10/1984 | Schuplin | |
| 4,525,971 | A | | 7/1985 | Kern | |
| 4,569,175 | A | | 2/1986 | Abciuk | |
| 4,599,831 | A | | 7/1986 | Magaha, Jr. | |
| 4,742,662 | A | | 5/1988 | Smith | |
| 4,744,188 | A | | 5/1988 | Ahren | |
| 4,747,246 | A | | 5/1988 | Sanborn | |
| 4,773,200 | A | | 9/1988 | Young | |
| 4,841,709 | A | * | 6/1989 | Peterson et al. | 52/664 |
| 4,875,320 | A | | 10/1989 | Sparkes | |
| 4,926,606 | A | * | 5/1990 | Hanson | 52/506.07 |
| 5,042,220 | A | | 8/1991 | Jackson | |
| 5,077,951 | A | | 1/1992 | Baker | |
| 5,165,209 | A | * | 11/1992 | Bischel et al. | 52/506.08 |
| 5,195,289 | A | | 3/1993 | LaLonde et al. | |
| 5,218,808 | A | | 6/1993 | Ardley | |
| 5,239,801 | A | | 8/1993 | Adams | |
| 5,414,969 | A | | 5/1995 | Krejci et al. | |
| 5,485,447 | A | | 1/1996 | Minoda | |
| 5,495,697 | A | | 3/1996 | Bischel et al. | |
| 5,743,054 | A | * | 4/1998 | Luchetti et al. | 52/220.7 |
| 5,941,040 | A | * | 8/1999 | McAnallen et al. | 52/586.1 |
| 6,029,413 | A | * | 2/2000 | Compas, Jr. | 52/506.06 |
| 6,101,777 | A | | 8/2000 | Bodine et al. | |
| 6,205,732 | B1 | | 3/2001 | Rebman | |
| 6,305,137 | B1 | | 10/2001 | Rebman | |
| 6,324,806 | B1 | | 12/2001 | Rebman | |
| 6,536,173 | B2 | | 3/2003 | Rebman | |
| 6,851,238 | B2 | | 2/2005 | Rebman | |
| 7,010,895 | B2 | | 3/2006 | Bruno | |
| 7,810,294 | B2 | * | 10/2010 | Maley | E04B 9/064 52/220.6 |
| 2005/0257476 | A1 | * | 11/2005 | Saidoo et al. | 52/506.07 |
| 2006/0090415 | A1 | * | 5/2006 | Savard | 52/633 |

* cited by examiner

SUSPENDED CEILING

CROSS-REFERENCE TO RELATED APPLICATION

This United States patent application relates to and claims priority from Canadian patent application number 2,588,300, filed on Apr. 30, 2007, entitled MEDIUM DENSITY FIBERBOARD (MDF) SUSPENDED CEILING, which is incorporated herein by reference.

FIELD OF THE INVENTION

The present invention relates to ceilings and more precisely to suspended ceilings. The invention more precisely relates to a kit of parts adapted to be assembled to form a ceiling.

BACKGROUND OF THE INVENTION

Suspended ceilings are usually made of a metal grid consisting of longitudinal parallel runners spaced apart from one another a desired distance and separated by cross members in a perpendicular fashion thereby creating a plurality of rectangular openings. In general, those rectangular openings are of standard sizes allowing the ventilation outlets and the lighting fixtures to be easily inserted among the ceiling panels.

Suspended ceilings have been mostly utilized in office buildings and in housing basements because of the handiness that such systems allow to repair and/or to modify the partition of the space. However, most development in suspended ceilings has been towards improving the convenience for offices, without any improvement to the visual aspect of the ceiling.

Indeed, the typical ceiling panels are made of fibrous material with a flat bottom finish, which are inserted in the rectangular openings made of the metal grid as disclosed in U.S. Pat. No. 2,971,617, No. 3,385,021 and No. 3,785,110. Such unappealing designs have restricted the installation of suspended ceilings in residential construction to the basement and hinder their distribution whenever an upscale finish is desired.

To improve the appearance of the conventional suspended ceilings, wooden or wood-like grid systems have been reported in U.S. Pat. Nos. 3,583,119, 3,557,506, 4,454,700, 4,281,498, 4,367,616, 4,452,021, 4,464,876, 4,525,971, 4,773,200, 5,218,808, and 7,010,895. Installation of such ceiling systems usually required additional manipulations and was used in conjunction with the conventional flat bottom fiberboard panels Therefore, a need has been found for an improved suspended ceiling. Similarly, a need has arisen for an improved suspended ceiling that is inexpensive to produce and easy to install.

SUMMARY OF THE INVENTION

An aspect of the present invention provides an improved modular ceiling over the prior art.

This invention relates to an easy-to-install suspended ceiling system and more specifically to the MDF composition of the panel, runners and cross members, which procure an aesthetical look.

One aspect of the present invention provides a modular ceiling comprising a plurality of runner members, cross members, Ogee and panels.

Another aspect of the present invention provides the runner member with a longitudinal retaining cavity on its upper surface to hang the runner member via a fastener engaged in the longitudinal retaining cavity.

Another aspect of the present invention provides the runner member with a longitudinal groove on its upper surface to secure corresponding cross members thereto.

One other aspect of the present invention provides a cross member with a longitudinal retaining cavity on its upper surface to receive a fastener adapted to engage the groove of the runner member.

Yet another aspect of the invention provides an Ogee member adapted to interface the ceiling with a wall, the Ogee member having a longitudinal retaining cavity defined thereon to hang the Ogee member via a fastener engaged in the longitudinal retaining cavity.

One aspect of the present invention provides a fastener adapted to mate with the longitudinal retaining cavity on one side and to connect to a support on the other side, the connection with the support also provides further vertical adjustment.

Another aspect of the invention provides an upper runner and a lower runner adapted to, in combination with a panel, change the vertical height of the ceiling from a first vertical height to a second vertical height.

One other aspect of the invention provides modular ceiling comprising a first main runner defining an upper surface and a lower surface, the upper surface defining a longitudinal retaining cavity along the first main runner and at least one recess provided on each side of the longitudinal retaining cavity; a second main runner adapted to be disposed parallel to the first main runner when assembling the modular ceiling, the second main runner defining an upper surface and a lower surface, the upper surface defining a longitudinal retaining cavity along the second main runner and at least one recess provided on each side of the longitudinal retaining cavity; a cross member installable at an angle from the main runners and adapted to connect the first main runner with the second main runner, the cross member being secured to the main runners by a cross member fastener having a cross runner anchor adapted to engage the recess defined in the main runners; and a panel adapted to be disposed between main runners and being supported, at least in part, by the main runners.

Another aspect of the invention provides a method for installing a modular ceiling, the method comprising suspending a first main runner defining an upper longitudinal retaining cavity along the first main runner, to suspend the first main member, the first main runner defining a recess and a lip on each side of the longitudinal retaining cavity; suspending a second main runner parallel to the first main runner, the second main runner defining an upper longitudinal retaining cavity along the second main runner, to suspend the first main member, the first main runner defining a recess and a lip on each side of the longitudinal retaining cavity; installing a cross member between the first and the second main runners; and securing a panel between the main runners by engaging the lips of the main runners.

One other aspect of the invention provides a kit for building a ceiling, the kit comprising a plurality of main runners, each main runner defining an upper longitudinal retaining cavity and a recess defined on each side of the longitudinal retaining cavity; a plurality of cross runners adapted to connect the main runners together; and a plurality of panels adapted to be disposed between the main runners and being supported by the main runners, the plurality of panels being adapted to be positioned relative to the main runners by the recesses defined in the main runners.

Embodiments of the present invention do not necessarily have all of the above-mentioned objects and/or aspects.

Additional and/or alternative features, aspects, and advantages of the embodiments of the present invention will become apparent from the following description, the accompanying drawings, and the appended claims.

The features of the invention will become more apparent in the following detailed description in which reference is made to the appended drawings wherein:

DETAILED DESCRIPTION OF THE INVENTION

The preferred embodiment illustrated in the Figures is one possible mechanical arrangement among other workable variations. These other workable variations are not considered to be enough materially distinctive so that a person skilled in the art of ceiling manufacturing and installation would not know how to adapt the present invention thereto.

Figure 1:
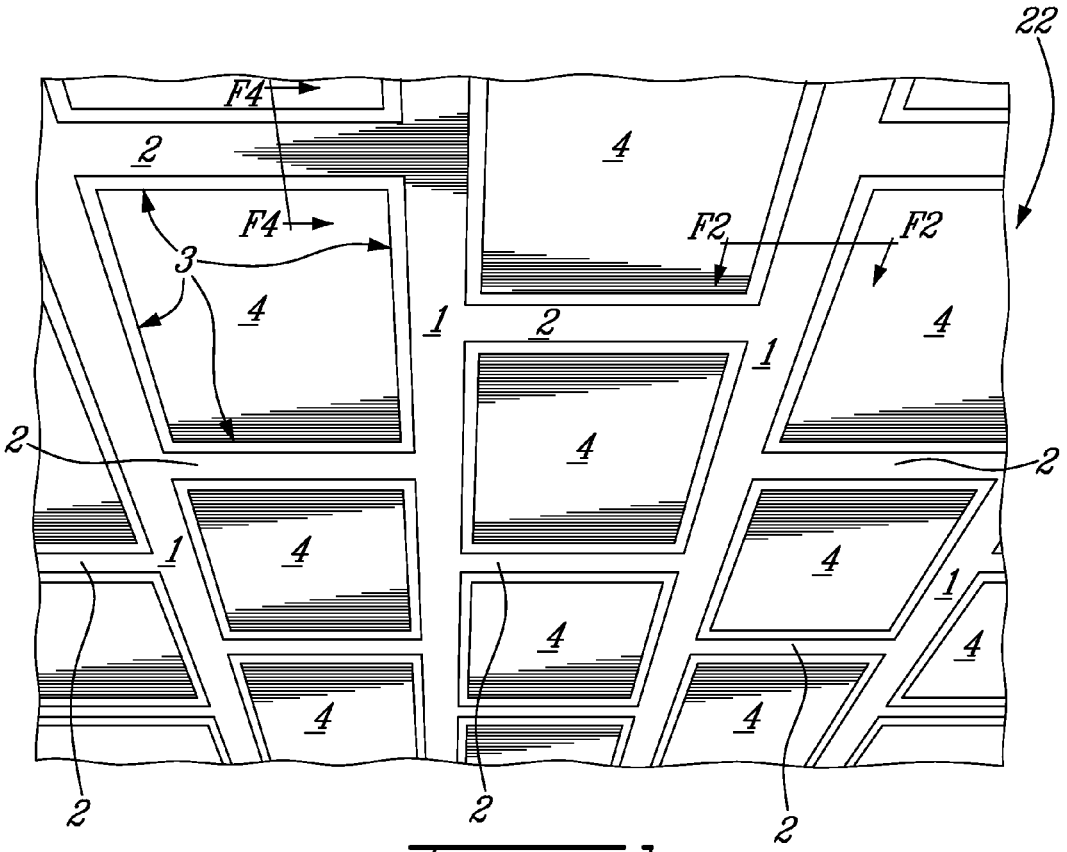
FIG. 1 is a perspective bottom view of the suspended ceiling of the present invention, wherein the plurality of runners and cross members gives rise to a lattice defining openings that can accommodate the profiled panels as well as the ventilation outlets and the lighting fixtures, if required.

FIG. 1 illustrates a suspended ceiling 22 built with a series of main runners 1 and cross members 2 in a lattice pattern. The surface covered by the modular ceiling 22 and the distance between main runners 1 and cross members 2 can also vary in accordance with the desired visual effect. On FIG. 1 the cross members 2 are illustratively alternated on each side of the main runners 1 but they could also be aligned. Panels 4 are installed in the openings formed by the lattice of main runners 1 and cross members 2.

Figure 2:
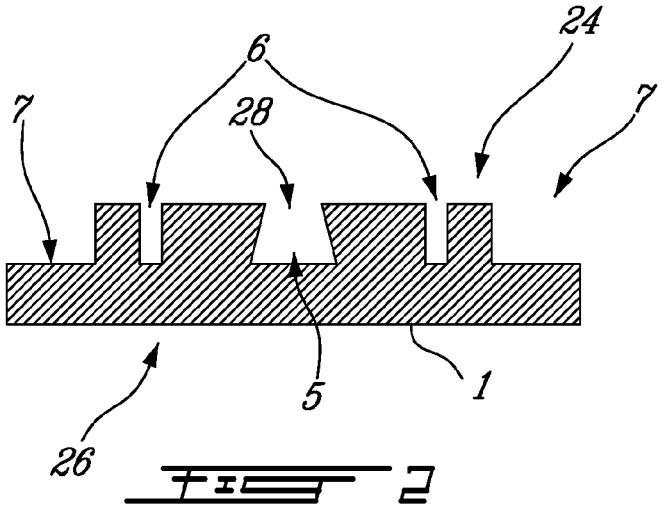
FIG. 2 is a cross sectional view of a runner.
Figure 3:
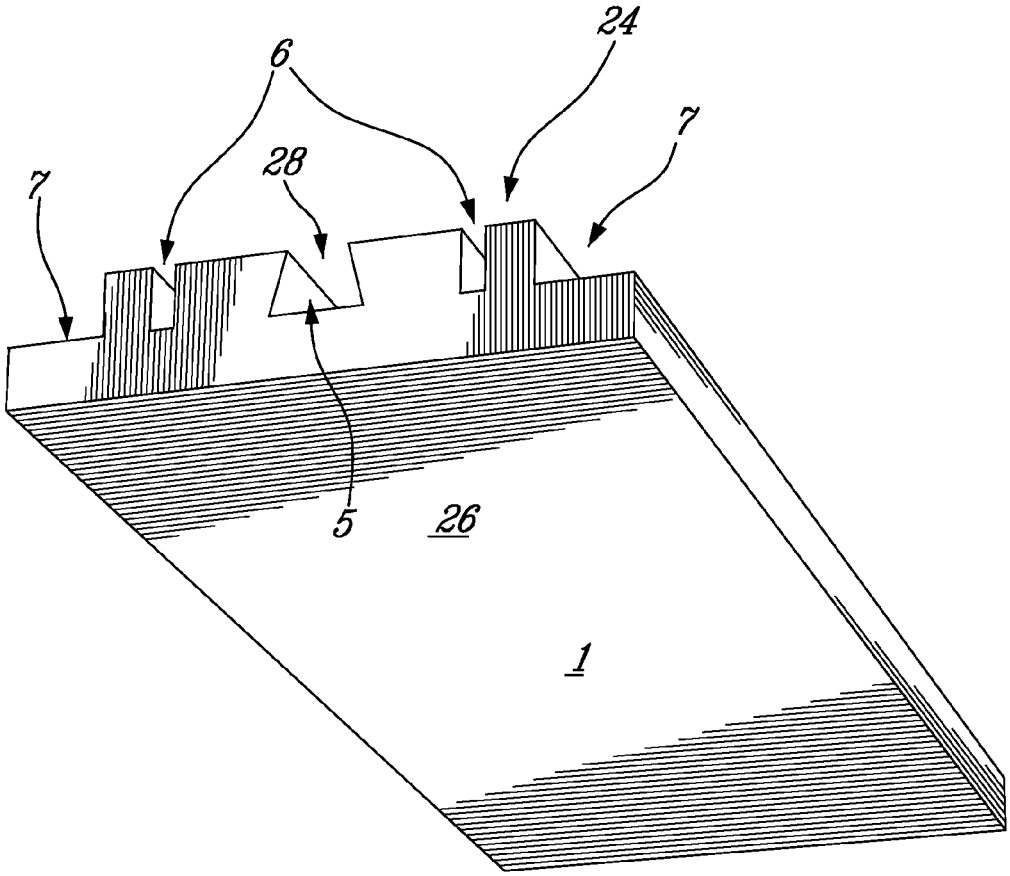
FIG. 3 is a three dimensional view of the runner of FIG. 2.

Referring to FIGS. 2 and 3 it is appreciated that the main runner 1 has an upper surface 24 facing the upper side of the room and a lower surface 26 facing the floor of the room in which the ceiling 22 is installed. The upper surface 24 comprises a longitudinal retaining cavity 5 preferably disposed in the center of the main runner 1. The longitudinal retaining cavity 5 is adapted to receive a fastener to suspend the main runners 1. The longitudinal retaining cavity 5 is preferably shaped to receive a fastener 36 having a dovetail shape 28 to easily secure the fastener 36 in the longitudinal retaining cavity 5. The dovetail shape 28 allows a strong and safe connection with the associated longitudinal retaining cavity 5.

The upper surface 24 also comprises two grooves 6 respectively disposed on each side of the longitudinal retaining cavity 5. The longitudinal retaining cavities 5 are adapted to position and secure the cross members 2 to the main runners 1. The fastening mechanism will be detailed later in the description.

Additionally the upper surface 24 defines two lips 7 disposed on each side of the upper surface 24 to receive and support the cooperating edge of the panel 4.

The longitudinal retaining cavity 5, the two grooves 6 and the lips 7 can be produced with the main runner 1 using an extrusion process given the main runner 1 can be made of plastic or aluminum. The longitudinal retaining cavity 5, the two grooves 6 and the lips 7 can alternatively be manufactured by adding portions of material on top of the bottom portion of the main runner 1 that is a rectangle. The additional portions of material can be glued or hot-welded depending on the process that is used.

The size of the main runner 1 is compact with its ~75 mm width to keep to a minimum the thickness so that the space needed above the main runner 1 is reduced to maximize the height of the room in which the ceiling is installed.

Figure 4:
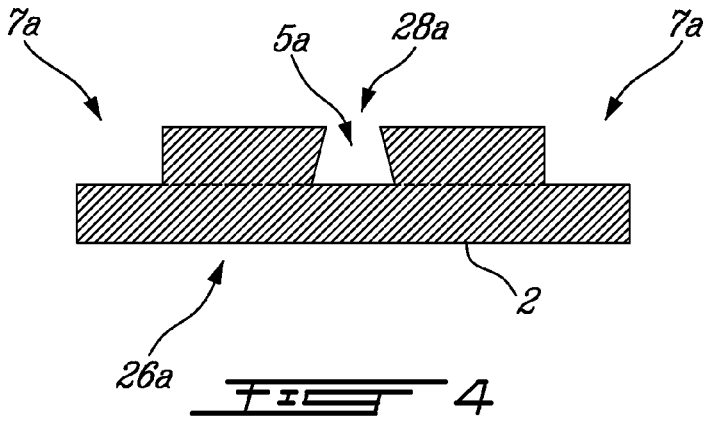
FIG. 4 is a cross sectional view of a cross member.
Figure 5:
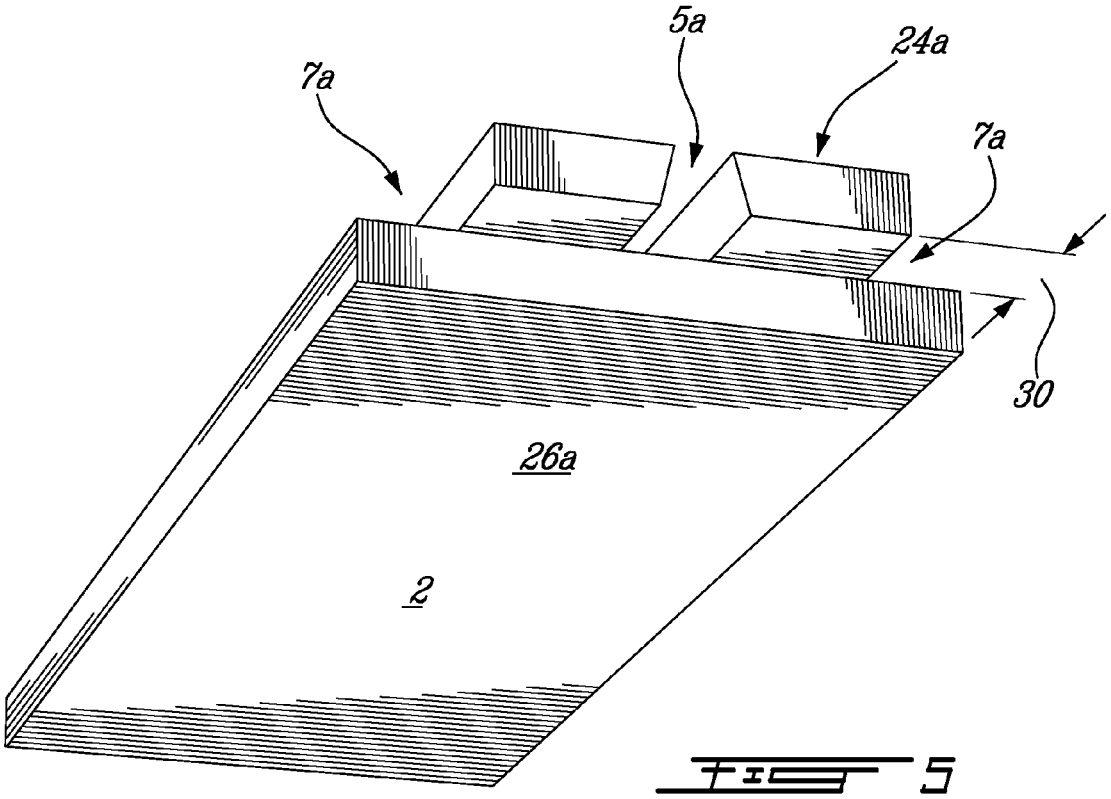
FIG. 5 is a three dimensional view of the cross member of FIG. 4.

FIGS. 4 and 5 illustrate the cross member 2 in isolation. It can be appreciated that the cross member 2 also has an upper surface 24*a* and a lower surface 26*a*. A longitudinal retaining cavity 5*a* and two lips 7*a* are also provided in the upper surface 24*a* of the cross member 2. A longitudinal extension 30 is provided at each end of the cross member 2. The longitudinal extension 30 is adapted to mate with the lip 7 of the main runner 1 thus providing support to the cross member 2. The same materials and manufacturing processes used for manufacturing the main runners 1 are suitable to manufacture the cross members 2.

Figure 6:
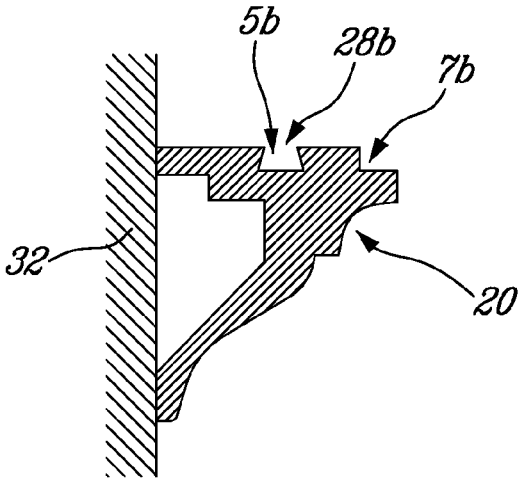
FIG. 6 is a cross sectional view of an optional ogee runner adapted for installation in the periphery of the lattice along the wall.

An ogee 20 is depicted on FIG. 6. The ogee 20 is a support member just as the main runner 1 and the cross member 2 with the difference that it is used where the ceiling 22 reaches a wall 32. The ogee 20 comprises a longitudinal retaining cavity 5*b* and a lip 7*b* that are similar to the above-described longitudinal retaining cavity 5/5*a* and lip 7/7*a* of the main runner 1 and of the cross member 2. The ogee 20 is secured to the wall with fasteners (i.e. nails, screws, . . . ), the fastener 36 using the longitudinal retaining cavity 5*b* or glued at the right height so that the ogee 20 can receive and support the adjacent cross members 2 and panels 4. The ogee 20 is manufacturable with similar materials and processes as the main runners 1.

Figure 7:
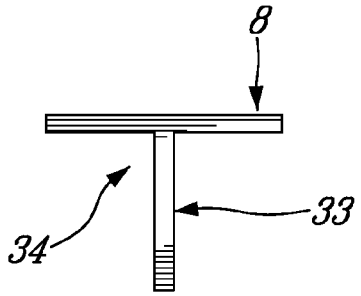
FIG. 7 is a cross sectional view of a ceiling anchor.
Figure 8:
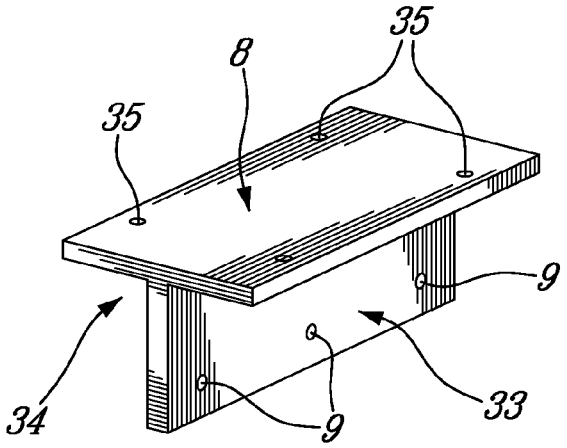
FIG. 8 is a three dimensional view of the ceiling anchor of FIG. 7.

FIG. 7 and FIG. 8 illustrate an illustrative cooperating part to the fastener used to suspend the main runner 1 and the cross member 2 by their longitudinal retaining cavity 5. The cooperative part shown on FIGS. 7 and 8 is a T-shaped support 34 adapted to be secured to a trust via holes 35 defined in a horizontal portion 8 of the T-shaped support 34, an above-ceiling structure 38 and also connects to the fastener 36. The T-shaped support 34 permits height adjustment by securing the corresponding fastener 36 at the right position with the holes 9 present in the vertical portion 33 of the T-shaped support 34.

Figure 9:
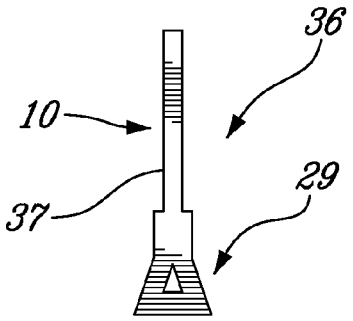
FIG. 9 is a cross sectional view of a dovetail runner anchor that is inserted into the runner dovetail groove.
Figure 10:
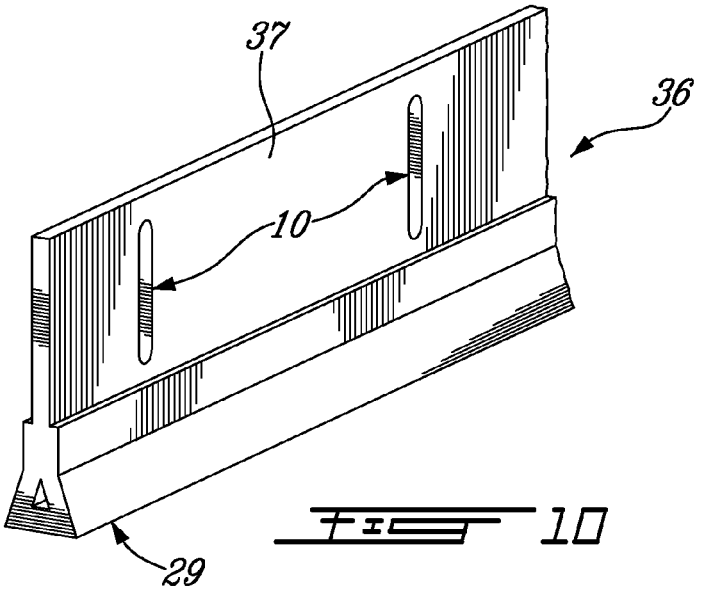
FIG. 10 is a three dimensional view of the dovetail runner anchor of FIG. 9.
Figure 11:
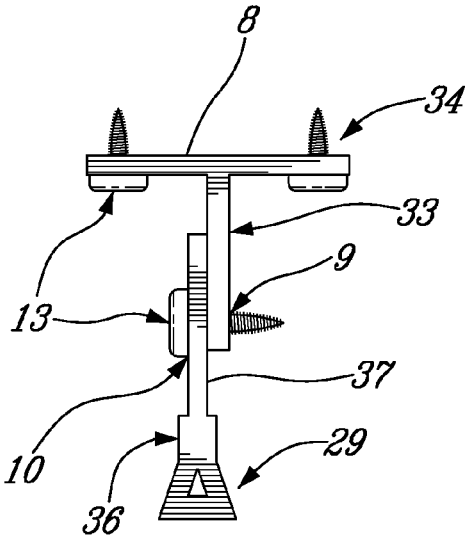
FIG. 11 is a cross sectional view of the assembly of the dovetail runner anchor to the ceiling anchor of FIGS. 7 and 9.

One can appreciate from FIG. 9 and FIG. 10 that the fastener 36 defines a shape adapted to cooperate with the longitudinal retaining cavity 5. In the present situation the shape provided by the fastener 36 is the male dovetail shape 29 adapted to cooperate with the female counterpart 28 that is the properly shaped longitudinal retaining cavity 5. The fastener 36 defines a vertical section 37 having a plurality of slots 10 adapted to receive a fastener to be secured to an associated connection member 34 (in the present situation, the T-shaped support 34) with a bolt or a screw 13 as shown on FIG. 11. The fastener 36 can be produced in plastic or aluminum with a proper extrusion process.

Figure 12:
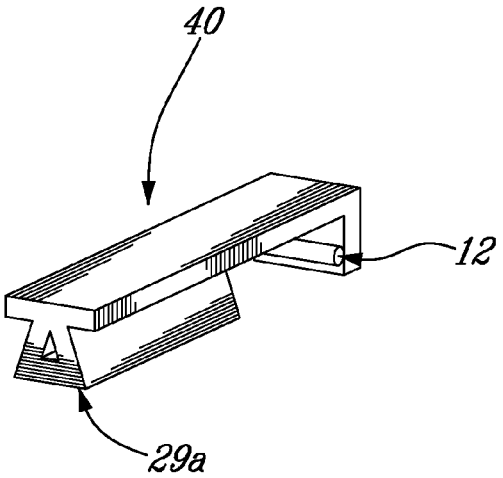
FIG. 12 is a three dimensional view of a cross member anchor.

FIG. 12 refers to a cross member fastener 40 defining on one side a shape 28 29*a* adapted to mate with the longitudinal retaining cavity 5*a* of the cross member 2 and defining on the opposite side a cross member anchor 12 adapted to engage the groove 6 of the runner 1. In the present example the dove tail 29*a* shaped side of the fastener 40 is inserted in the longitudinal retaining cavity 5*a* of a cross member 2 and the cross member 2 is positioned next to a runner 1 to insert the cross member anchor 12 in the groove 6 of the runner 1 to secure the cross member 2 to the runner 1. The longitudinal extension 30 of the cross member 2 is adapted to rest on the lip 7 of the runner 1 to help transfer the load of the cross member 2 (and the panel 4 resting on the cross member) to the runner 1.

Figure 13:
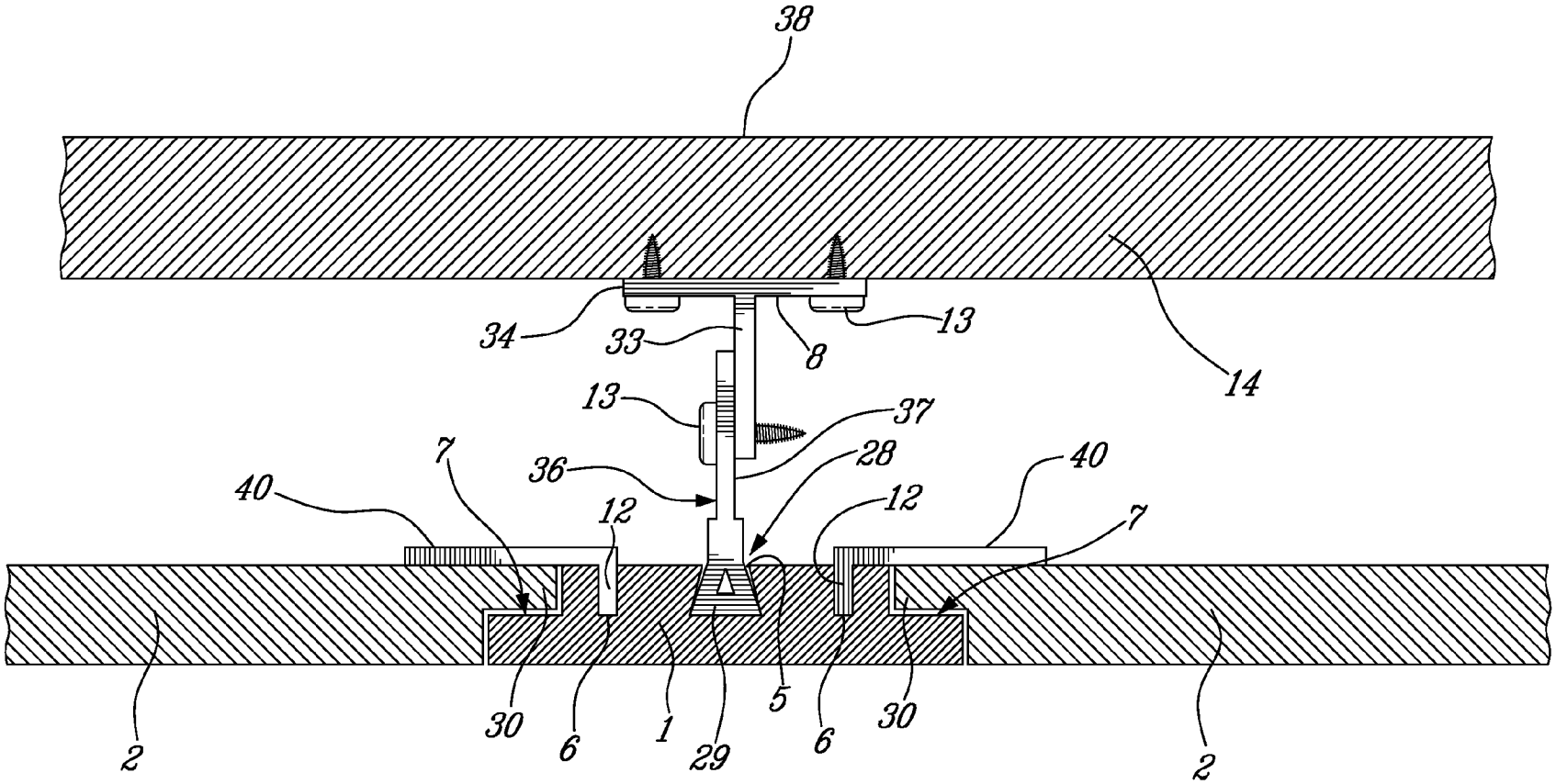
FIG. 13 is an overall view of the anchoring system that allows the runner and cross member to be secured to an overhead structure of the building.

FIG. 13 illustrates an assembly of two cross members 2 with an adjacent runner 1. It can be appreciated that each cross member 2 uses a cross member fastener 40 engaging both the longitudinal retaining cavities of the cross member 2 and the groove 6 of the runner 1. The runner 1 is hung to the above-ceiling structure 38 with the fastener 36 engaged on one side with the longitudinal retaining cavity 5 of the runner 1 and to the T-shaped support 40 on the other side.

Figure 14:
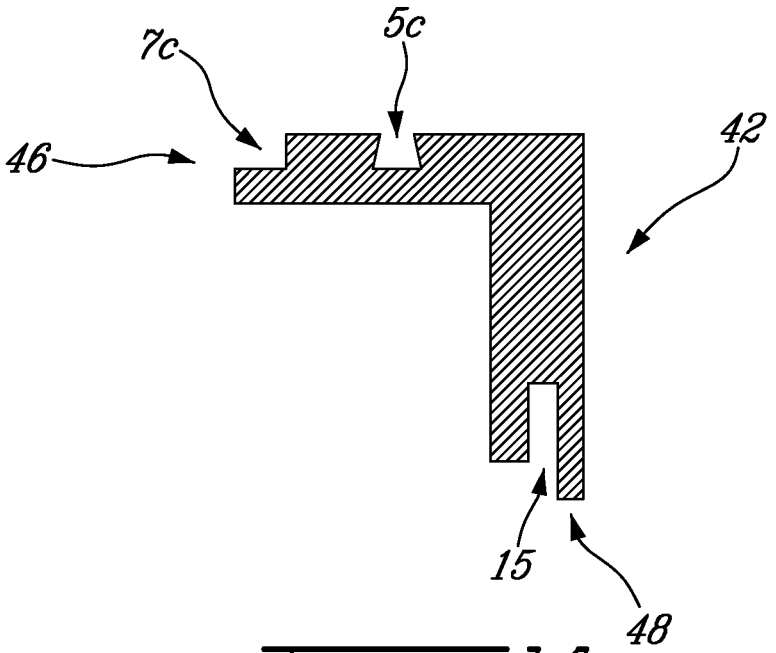
FIGS. 14 and 15 are cross sectional views of optional lower and upper runners adapted specifically to be used together for the addition of vertical panel.
Figure 15:
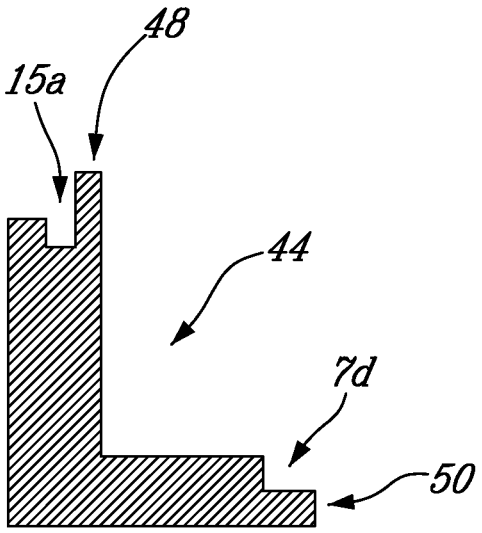

Turning now to FIG. 14 and FIG. 15 displaying respectively an upper runner 42 and a lower runner 44. The upper runner 42 and the lower runner 44 are generally used collectively to change the direction of the ceiling from the usual horizontal position 46 to a vertical position 48 and back to a horizontal position 50 in order to manage a change in height of the ceiling. The upper runner 42 provides, on a first side, a longitudinal retaining cavity 5*c* to secure the upper runner 42 and a lip 7*c* to receive a panel 4. In contrast the second side provides a groove 15 adapted to accommodate the panel 4. Similarly, the lower runner 44 provides, on a first side, a lip 7*d* to support a panel. The second side of the lower runner 44 provides a groove 15*a* adapted to accommodate the panel 4. These runners 42, 44 can be suspended or directly secured to a beam or any suitable member using fasteners or glue.

Although the invention has been described with reference to certain specific embodiments, various modifications and improvements thereof will be apparent to those skilled in the art without departing from the spirit and scope of the invention as outlined in the claims appended hereto. The entire disclosures of all references recited above are incorporated herein by reference.

What is claimed is:

1. A modular ceiling comprising:

a first main runner defining an upper surface thereof and a lower surface thereof, the upper surface of the first main runner defining a longitudinal retaining cavity along the first main runner and at least one lip provided on each side of the longitudinal retaining cavity of the first main runner;

a second main runner adapted to be disposed parallel to the first main runner when assembling the modular ceiling, the second main runner defining an upper surface thereof and a lower surface thereof, the upper surface of the second main runner defining a longitudinal retaining cavity along the second main runner and at least one lip provided on each side of the longitudinal retaining cavity of the second main runner;

a cross member installable at an angle from the main runners and adapted to connect the first main runner with the second main runner, the cross member having at least one extension at least one end thereof and being mounted onto the main runners by positioning the extension thereof on respective lips of the main runners;

a cross member fastener comprising a plank element from which extends on one side thereof a mating tail shape and on an opposite side thereof an anchor, the mating tail shape and the anchor are spaced apart along the length of the plank element, the mating tail shape adapted to engage a cavity defined by the cross member, the anchor adapted to engage a groove defined in the main runners on at least one side of the longitudinal retaining cavity of the main runners;

a panel adapted to be disposed between the main runners and being supported, at least in part, by the main runners; and an upper runner and a lower runner, each of the upper and lower runners comprising of an L-shape with first and second terminal ends, the upper runner being adapted to be installed in substantial vertical alignment with the lower runner to vertically secure a side panel therebetween, the upper runner being adapted to interact with a panel horizontally disposed at a first vertical level and the lower runner being adapted to interact with a panel horizontally disposed at a second vertical level lower than the first vertical level, wherein the upper runner comprises a longitudinal retaining cavity formed on an upper surface of the upper runner and adapted to receive a fastener to vertically support the upper runner, a lip formed in the first terminal end of the L-shaped upper runner and adapted to receive the panel horizontally disposed at the first vertical level, and a groove formed in the second terminal end of the L-shaped upper runner and adapted to accommodate the side panel, and wherein the lower runner comprises a lip formed in the first terminal end of the L-shaped lower runner and adapted to receive the panel horizontally disposed at the second vertical level and a groove formed in the second terminal end of the L-shaped lower runner and adapted to accommodate the side panel.

2. The modular ceiling of claim 1, wherein the main runners are made of polymer and wherein the main runners are manufactured with an extrusion process.

3. The modular ceiling of claim 1, further comprising an ogee adapted to be installed on the periphery of the ceiling next to a wall, the ogee comprising an upper surface thereof defining an ogee longitudinal retaining cavity and an ogee lip adapted to interact with the panel.

4. The modular ceiling of claim 1, wherein the cross member defines an upper surface thereof and a lower surface thereof, the upper surface of the cross member defining a cross member longitudinal retaining cavity adapted to suspend the cross member.

5. The modular ceiling of claim 1, comprising a fastener, for each main runner, adapted to mate with the longitudinal retaining cavity of each main runner to vertically support the main runners.

6. The modular ceiling of claim 5, wherein the fasteners and the longitudinal retaining cavity of each main runner have mating dovetail shapes, the fasteners being adapted to be connected to a hidden structure so as to suspend the main runners therefrom.

7. The modular ceiling of claim 5, comprising a connection member adapted to be secured to the fasteners to extend the vertical reach of the fasteners.

8. The modular ceiling of claim 1, wherein each, lip of each main runner is adapted to support the panel.

* * * * *